US006088833A

United States Patent [19]

Welchel et al.

[11] Patent Number: 6,088,833

[45] **Date of Patent: *Jul. 18, 2000**

[54] EXPANDABLE BACKPACK FOR ENCAPSULATED CHEMICAL PROTECTION SUIT

[75] Inventors: Debra Nell Welchel, Woodstock; Vivian Gray, Marietta; Alan Edward Wright, Woodstock, all of Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/940,904

[22] Filed: Sep. 30, 1997

[51] Int. Cl.[7] ..... A41D 3/00; A41D 13/02; A62B 17/00

[52] U.S. Cl. ..... 2/69; 2/457; 2/901

[58] Field of Search ..... 2/69, 456, 457, 2/458, 2.11, 94, 1, 2.14, 2.15, 901

[56] References Cited

U.S. PATENT DOCUMENTS

| | | | |
|---|---|---|---|
| 1,367,182 | 2/1921 | Gardi . | |
| 1,426,024 | 8/1922 | Thureson . | |
| 2,150,251 | 3/1939 | Shanhouse . | |
| 2,248,455 | 7/1941 | Freund . | |
| 2,448,416 | 8/1948 | Carter . | |
| 2,507,322 | 5/1950 | Smith . | |
| 2,620,479 | 12/1952 | Buck | 2/94 |
| 4,100,324 | 7/1998 | Anderson et al. | 428/288 |
| 4,257,127 | 3/1981 | Kaupin et al. | 2/75 |
| 4,286,439 | 9/1981 | Pasternack . | |
| 4,403,608 | 9/1983 | Warncke | 128/201.28 |
| 4,434,920 | 3/1984 | Moore | 224/160 |
| 4,581,752 | 4/1986 | De Luca | 378/62 |
| 4,670,913 | 6/1987 | Morell et al. | 2/227 |
| 4,689,831 | 9/1987 | Greenberger et al. | 2/93 |
| 4,720,415 | 1/1988 | Vander Wielen et al. | 428/152 |
| 4,864,654 | 9/1989 | Schriver et al. | 2/84 |
| 4,884,731 | 12/1989 | Sibley | 224/215 |
| 4,949,401 | 8/1990 | Kimsey . | |

(List continued on next page.)

FOREIGN PATENT DOCUMENTS

| | | |
|---|---|---|
| 0 432 492 | 6/1991 | European Pat. Off. . |
| 0672357 A2 | 2/1995 | European Pat. Off. . |
| 1577493 | 8/1969 | France . |
| 2221246 | 10/1974 | France . |
| 2309115 | 11/1976 | France . |
| 2497443 | 7/1982 | France . |
| 2586174 | 2/1987 | France . |
| 1187487 | 2/1965 | Germany . |
| 3603639A1 | 8/1987 | Germany . |
| 2199233 | 7/1988 | United Kingdom . |
| 94/12065 | 6/1994 | WIPO . |
| WO 95/08276 | 3/1995 | WIPO . |

OTHER PUBLICATIONS

PCT Search Report PCT/US 98/15790.
GB 1240939—the English equivalent for FR 1577493.
Copy of PCT Search Report for PCT/US98/20345.
Patent Abstracts of Japan, vol. 098, No. 011, Sep. 30, 1998 & JP 10 168612A, (Onyone KK), Jun. 23, 1998.
Abstract of French 2309115, Nov. 19, 1976.
Abstract for French 2221246, Oct. 11, 1974.
Abstract of French 2497443, Jul. 7, 1982.
Abstract for French 2586174, Feb. 20, 1987.
Abstract for EP 0 432 492.
Abstract for DE 1,187,487.
Ser. No. 60/056,984 Filing Date Aug. 26, 1997 Title Protective Garment And Method Of Manufacture.

*Primary Examiner*—John J. Calvert
*Assistant Examiner*—Shirra L. Jenkins
*Attorney, Agent, or Firm*—William E. Maycock

[57] ABSTRACT

The present invention is directed toward protective garments which include an expandable backpack portion located on the back area of the garment. The backpack portion includes at least one pair of left and right generally vertical pleats. As a result of the incorporation of the pair of left and right generally vertical pleats, the backpack portion has the ability to expand to receive life support or other equipment worn on the back of a wearer of the protective garment.

20 Claims, 11 Drawing Sheets

U.S. PATENT DOCUMENTS

| | | | |
|---|---|---|---|
| 4,981,747 | 1/1991 | Morman | 428/198 |
| 4,992,335 | 2/1991 | Guerra et al. | 428/518 |
| 5,005,216 | 4/1991 | Blackburn et al. | 2/79 |
| 5,019,453 | 5/1991 | Guerra | 428/518 |
| 5,034,998 | 7/1991 | Kolsky | 2/2 |
| 5,035,941 | 7/1991 | Blackburn | 428/286 |
| 5,116,662 | 5/1992 | Morman | 428/198 |
| 5,123,117 | 6/1992 | Prendergast . | |
| 5,221,572 | 6/1993 | Meunier | 428/231 |
| 5,279,287 | 1/1994 | Wiseman, Sr. | 128/201.29 |
| 5,336,545 | 8/1994 | Morman | 428/152 |
| 5,407,112 | 4/1995 | Christodoulou et al. | 224/153 |
| 5,421,326 | 6/1995 | Rankin et al | 128/201.19 |
| 5,429,707 | 7/1995 | Smith | 156/515 |
| 5,435,045 | 7/1995 | Anscher | 24/482 |
| 5,453,314 | 9/1995 | Collier et al. | 428/198 |
| 5,487,189 | 1/1996 | Bell | 2/79 |
| 5,491,022 | 2/1996 | Smith | 428/224 |
| 5,492,753 | 2/1996 | Levy et al. | 428/219 |
| 5,494,720 | 2/1996 | Smith et al. | 428/57 |
| 5,509,142 | 4/1996 | Connell et al. | 2/79 |
| 5,520,980 | 5/1996 | Morgan et al. | 428/246 |
| 5,529,830 | 6/1996 | Dutta et al. | 428/176 |
| 5,560,974 | 10/1996 | Langley | 428/198 |
| 5,588,153 | 12/1996 | Ignon et al. | 2/457 |
| 5,624,729 | 4/1997 | Cohen et al. | 428/90 |
| 5,634,579 | 6/1997 | Baclawski | 224/637 |
| 5,689,968 | 11/1997 | Frustaci et al. | 62/259.3 |
| 5,699,560 | 12/1997 | Greenberg | 2/94 |
| 5,743,447 | 4/1998 | McDermott | 224/153 |

EXPANDABLE BACKPACK FOR ENCAPSULATED CHEMICAL PROTECTION SUIT

FIELD OF THE INVENTION

The field of the present invention is that of protective apparel.

BACKGROUND OF THE INVENTION

As was stated in U.S. provisional patent application serial No. 60/056,984 entitled "Protective Garment And Method Of Manufacture" filed on Aug. 26, 1997, in the names of Debra Nell Welchel, Alan Edward Wright, Jay Amedee Poppe and Vivian Grey, there are many types of limited use or disposable protective garments and apparel designed to provide barrier properties. The entirety of this application is hereby incorporated by reference.

One type of protective garment is protective coveralls. Coveralls can be used to effectively seal off a wearer from a harmful environment in ways that open or cloak style garments such as, for example, drapes, gowns, shirts, pants and the like are unable to do. Accordingly, coveralls have many applications where isolation of a wearer from a work environment is desirable. For example, it may be desirable to isolate a worker from a hazardous environment. As another example, it may be desirable to isolate an environment (e.g., a clean room) from a worker.

For a variety of reasons, it is desirable for protective garments to be manufactured from materials which prevent or significantly retard the passage of hazardous liquids and/or pathogens therethrough. It is also desirable for the protective apparel to isolate persons from dusts, powders, and other particulates which may be present in a work place or accident site. Generally speaking, protective apparel rely on the barrier properties of the fabrics used in their construction. Some of these fabrics may even have received treatments to enhance barrier properties.

Barrier performance of protective apparel also depends on the design and construction of the garment. Apparel containing many seams may be unsatisfactory, especially if the seams are located in positions where they may be subjected to stress and/or direct contact with hazardous substances. Seams located at the front of apparel are particularly susceptible to stress and/or direct contact with hazardous substances. For example, seams that join sleeves or legs to the body portion of protective coveralls are often subjected to stress. Moreover, sleeve seams in the front of coveralls and seams about the chest are at locations of frequent accidental splashing, spraying and/or other exposures.

After use, it can be quite costly to decontaminate protective apparel that has been exposed to hazardous substances. Thus, there exists a need in the art for protective apparel which is more easily decontaminated.

Protective apparel (garments) must be worn correctly to reduce the chance of exposure. Workers are more likely to wear protective garments (e.g., protective coveralls) properly if the garments are comfortable. One way to increase comfort is to have the garment fit well. A protective garment that fits well also is advantageous in that, when the wearer is working in a confined space, generally speaking, the better fitting the protective garment, the less likely it is that the protective garment will be inadvertently torn, punctured or get "hung up on" the worker's surroundings. This is so because a good fitting protective garment will tend to conform more closely to the wearer's body. Accordingly, if the wearer stays clear of surrounding projections etc., as is the natural tendency, the likelihood of the protective garment contacting projections etc. will be decreased.

One of the problems associated with achieving a satisfactory fit in those protective garments which totally enclose the wearer is the fact that the wearer of the garment, because s/he is totally enclosed by the garment, needs to wear equipment, such as life support air tanks, on his/her back.

Accordingly, in such instances, the protective garment must also enclose this equipment. Past protective garment designs have attempted to address this problem by incorporating a backpack onto the back area of the garment. This backpack may be envisioned as joining a bag shaped appendage about an opening located in the back area of the garment with the opening and the bag being shaped to receive equipment such as, for example, life support equipment.

While these prior backpack containing protective garments have been marketed and sold, they are not without problems. One problem is that these backpacks do not possess any viable mechanism by which they tend to conform to the equipment. That is, there is no mechanism urging a tight, yet comfortable, fit. Accordingly, the bag portion of these backpacks tends to hang down in a crumpled or multi-folded manner. The downward hanging of these packs creates its own problems in that the bag portion of the backpack has a greater tendency to hang-up on or get snagged by objects in the work area. Naturally, this situation is not desirable in that it may well lead to the garment being ripped or torn and thus compromised. Another problem associate with this type of backpack on protective garments is the fact that the many folds in the bag portion of the garment tend to retain contaminates from the work area. This makes decontamination of the garment when the wearer wishes to exit it more difficult, time consuming and thus, more frustrating.

Thus, a need exists for an inexpensive protective garment with attached backpack which provides a better fit, is more comfortable to wear, reduces the tendency of the backpack to snag and/or which reduces the degree of retention of contaminates retained within the folds of the backpack.

OBJECTS OF THE INVENTION

Accordingly, it is a general object of the present invention is to provide protective apparel which has the ability to enclose life support equipment worn on the back of the wearer of the apparel.

Another object of the present invention is to provide protective apparel which has the ability to enclose life support equipment worn on the back of the wearer of the apparel which is comfortable.

Yet another object of the present invention is to provide protective apparel where the portion of the apparel which is designed to enclose life support equipment worn on the back of the wearer has the ability to variably expand to closely conform to the life support equipment.

One other object of the present invention is to provide protective apparel where the portion of the suit which is designed to enclose the life support equipment is designed to lessen greatly, if not eliminate, the retention of liquids and solids which the wearer might encounter during utilization of the apparel within the folds of the expandable portion.

Still further objects and the broad scope of applicability of the present invention will become apparent to those of skill in the art from the details given hereinafter. However, it should be understood that the detailed description of the presently preferred embodiment of the present invention is given only by way of illustration because various changes and modifications well within the spirit and scope of the invention will become apparent to those of skill in the art in view of the following description.

DEFINITIONS

As used herein the term "pleat" refers to a section of cloth or other material which has been folded 180 degrees back upon itself where, in a closed configuration, one of the surfaces of the cloth or other material is in close, if not touching configuration with itself. Opening of the pleat results from rotation, about the fold, of either or both of the two sections of cloth or other material adjacent the fold. One type of pleat is common pleats which can be single pleats as is illustrated in FIG. 1., double pleats as illustrated in FIG. 2, triple pleats, as illustrated in FIG. 3 and so on. Common pleats can be 100% juxtaposed, that is completely overlap, 0% juxtaposed, as illustrated in FIG. 5 or, if desired, partially juxtaposed, as illustrated in FIG. 4. In other words, common pleats can have a juxtaposition value of from 0 to 100%. Other types of pleats are the box pleat and the inverted pleat.

As used herein the term "generally vertical" refers to a configuration which an ordinary observer would consider to be vertical. Specific reference is made to this term throughout this application with respect to the pleats of the backpack. The term refers to the position of the pleats when the protective garment is worn. From another perspective, the wearer of the protective suit's backbone would be the reference point for any determination of verticality. Thus, any protective garment where the pleats were designed to be parallel to the wearer's backbone would have "vertical" pleats. Accordingly, the term "generally vertical" is intended to encompass designs where the alignment of the pleats varies from that of the wearer's backbone by no more than 25 degrees.

As used herein, any given range is intended to include any and all lesser included ranges. For example, a range of from 45–90 would also include 50–90; 45–80; 46–89 and the like.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates or materials added to enhance processability of a composition.

SUMMARY OF THE INVENTION

In response to the foregoing challenges which have been experienced by those of skill in the protective apparel art the present invention is directed toward a protective garment which includes an expandable backpack portion located on the back portion or area of the garment. The backpack portion includes at least one pair of left and right generally vertical pleats. As a result of the incorporation of the pair of left and right generally vertical pleats, the backpack portion has the ability to expand to receive life support or other equipment worn on the back of a wearer of the protective garment.

The pleat type may be single, double, triple or other greater multiple. However, as the pleat type multiple increases, some of the advantages of the present invention are diminished. Desirably, the pleat type is double pleats.

Where the pleats are single pleats, it is desirable for them to have a width of from about 1.5 inch to about 2.5 inches. More desirably, single type pleats may have a pleat width of about 2 inches.

Where the pleats are double pleats, it is desirable for them to have a width of from about 1.5 inch to about 2.5 inches. As is the case with single type pleats, double type pleats more desirably have a pleat width of about 2 inches.

Where the pleats are triple pleats, it is desirable for them to have a width of from 2.5 to 3 inches. More desirably, triple type pleats may have a pleat width of about 2.75 inches.

In some embodiments, the protective garment will include at least two pairs of generally vertical pleats. While these pairs of pleats may be juxtaposed from 0% to 100% and offset, desirably the pairs of pleats are not juxtaposed (0% juxtaposition) and not offset.

In some embodiments the pair or pairs of left and right generally vertical pleats terminate, at the bottom, in a contaminate runoff angle of from greater than 0 degrees to 90 degrees. More desirably, the contaminate runoff angle is greater than 0 degrees and less than 90 degrees. For example, the contaminate runoff angle may vary from about 30 degrees to about 60 degrees. Even more particularly, the contaminate runoff angle may be about 45 degrees.

In some embodiments the pair or pairs of generally vertical pleats terminate, at the top, to define an upward concave arc.

In some embodiments the inner pleat folds of the uppermost pair of left and right pleats are separated by at least 0.25 inch. For example, the inner pleat folds of the uppermost pair of pleats may be separated by at least 0.5 inch.

DETAILED DESCRIPTION OF THE INVENTION

Figure 1:
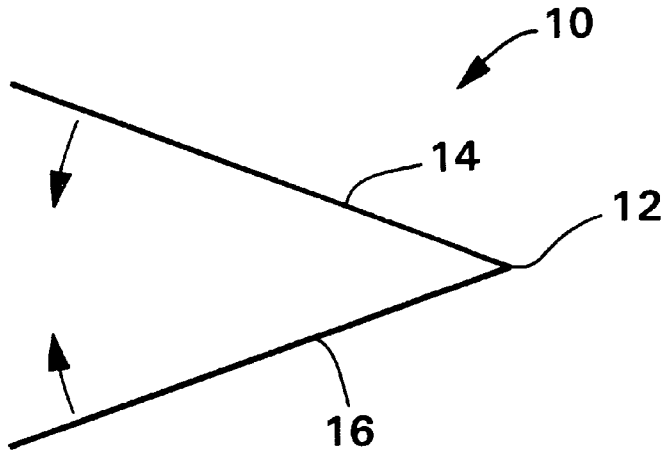
FIG. 1 is a cross-sectional view of a single type pleat slightly opened for clarity.

Turning now to the drawings where like reference numerals represent like or equivalent structure or process steps, FIG. 1 is a cross-sectional view of a right-hand, single type pleat 10. Single type pleats 10 are formed by folding a sheet of cloth or other material about a fold line 12 to form two adjacent portions 14 and 16. This action is indicated by the arrows in FIG. 1.

Figure 2:
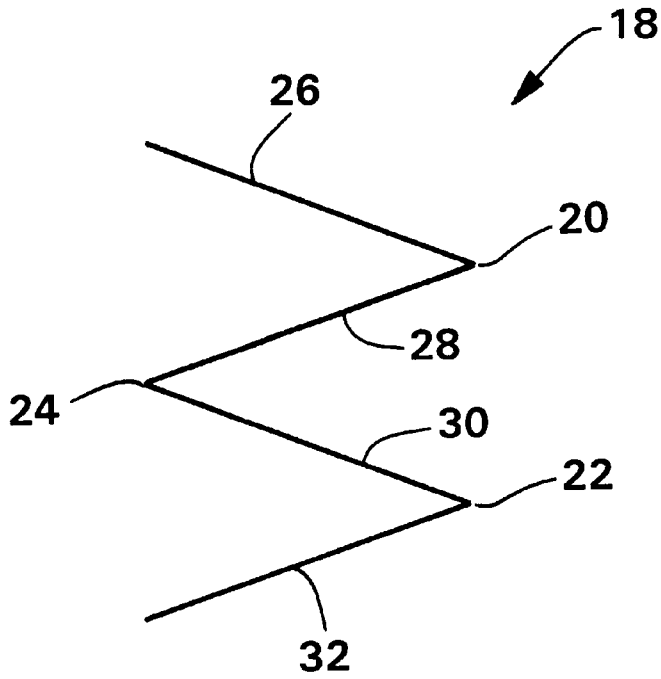
FIG. 2 is a cross-sectional view of a double type pleat slightly opened for clarity.

FIG. 2 is a cross-sectional view of a right-hand, double type pleat 18. A double type pleat is equivalent to a pair of adjacent single type pleats which have 100% juxtaposition, as will be explained in detail herein. Double type pleats 18 are formed by folding a sheet of cloth or other material about three fold lines 20, 22 and 24 in alternating fold directions as seen in FIG. 2. Fold lines 20 and 22 are outside fold lines and fold line 24 is an inside fold line. The material from which the double pleat is formed is folded in such a manner as to form four portions 26, 28, 30 and 32. These portions may be viewed as adjacent pairs with portions 26 and 28 being an adjacent pair and separated by outer fold line 20. Likewise, portions 30 and 32 are adjacent and separated by outer fold line 22. Also, portions 28 and 30 are adjacent and separated by inner fold line 24. When a double pleat is closed the outer fold lines 20 and 22 will be superimposed upon each other.

Figure 3:
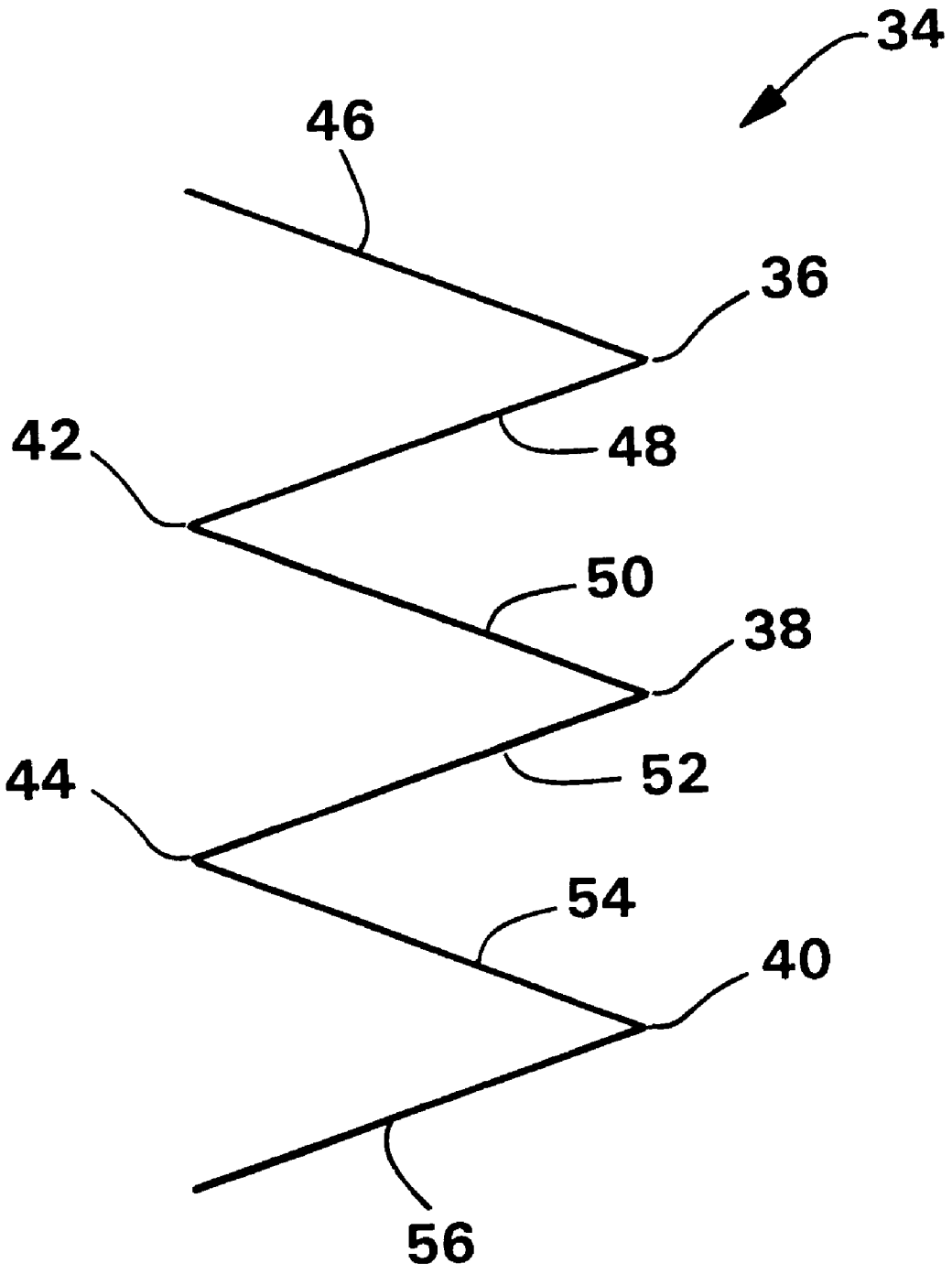
FIG. 3 is a cross-sectional view of a triple type pleat slightly opened for clarity.

FIG. 3 is a cross-sectional view of a right-hand, triple type pleat 34. A triple type pleat is equivalent to three adjacent single type pleats which have 100% juxtaposition. Triple type pleats 34 are formed by folding a sheet of cloth or other material about five fold lines 36, 38, 40, 42 and 44 in alternating fold directions as seen in FIG. 3. Fold lines 36, 38 and 40 are outside fold lines and fold lines 42 and 44 are inside fold lines. The material from which the triple pleat is formed is folded in such a manner as to form six portions 46, 48, 50, 52, 54 and 56. These portions may be viewed as adjacent pairs with portions 46 and 48 being an adjacent pair and separated by outer fold line 36. Likewise, portions 50 and 52 are adjacent and separated by outer fold line 38 just like portions 54 and 56 are adjacent and separated by outer fold line 40. Also, portions 48 and 50 are adjacent and separated by inner fold line 42 and portions 52 and 54 are adjacent and separated by inner fold line 44. When a triple pleat is closed the outer fold lines 36, 38 and 40 will be superimposed upon each other.

Figure 4:
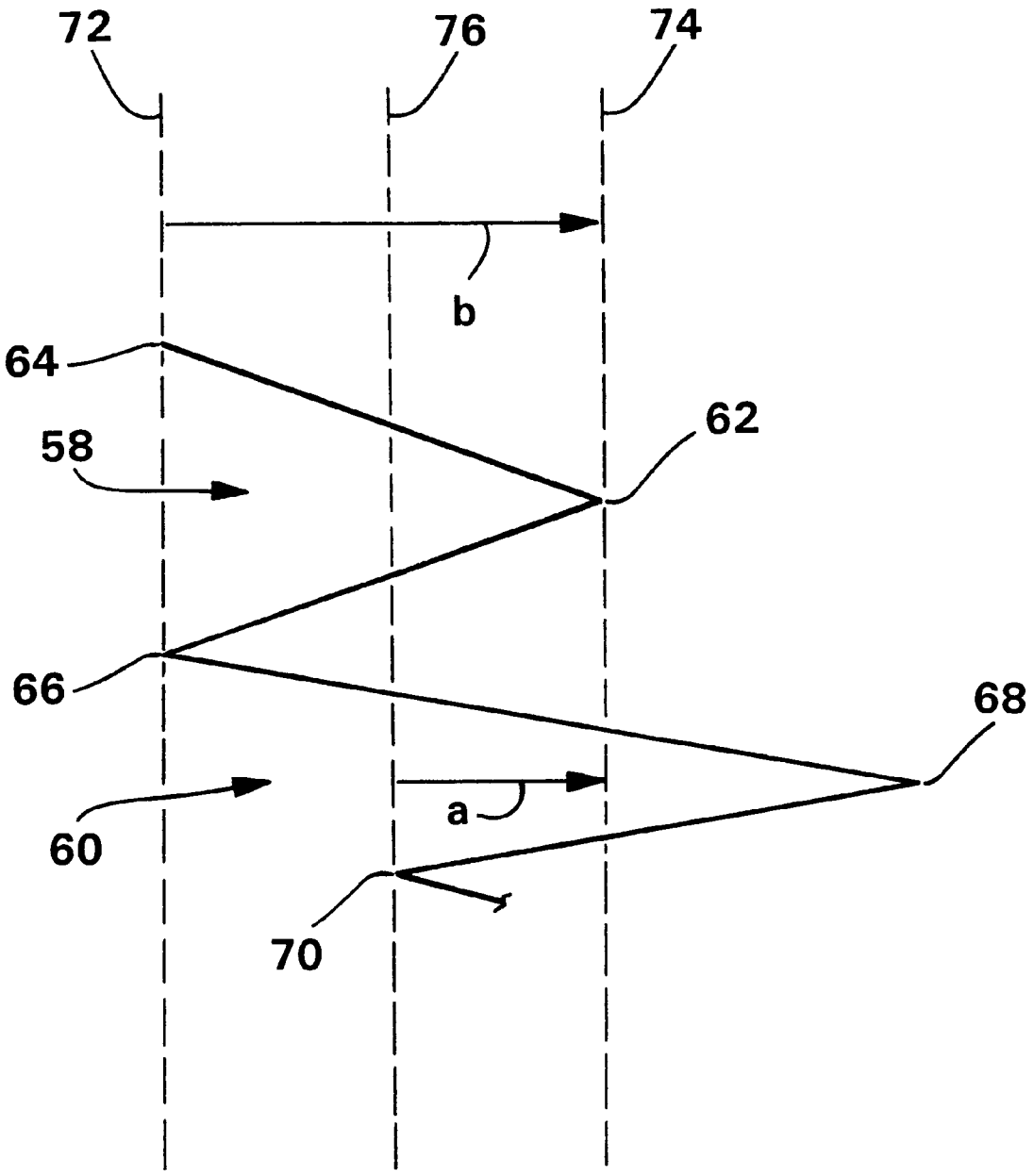
FIG. 4 is a cross-sectional view of two adjacent single type pleats, slightly opened for clarity, which have 50% juxtaposition.

FIG. 4 is a cross-sectional view of two adjacent, right-hand single type pleats 58 and 60. Pleat 58 has an outer fold point or line 62 and inner fold points or lines 64, 66. Pleat 60 has an outer fold point or line 68 and inner fold points or lines 66, 70. FIG. 4. illustrates the concept of juxtaposition and the degree or percentage of juxtaposition. To determine the percentage of juxtaposition of adjacent pleats, it is necessary to construct three imaginary lines. The first line 72 passes through the inner fold points or lines of pleat 58. The second imaginary line 74 passes through the outer fold point or line 62 of pleat 58 and is parallel to line 72. The third imaginary line 76 passes through the inner fold point or line 70 of pleat 60 and is parallel to the other two imaginary lines 72, 74. The degree of juxtaposition of pleat 60 as regards pleat 58 is calculated by dividing the distance "a" between line 76 and line 74 by the distance "b" between the line 72 and 74 and multiplying by 100.

Figure 5:
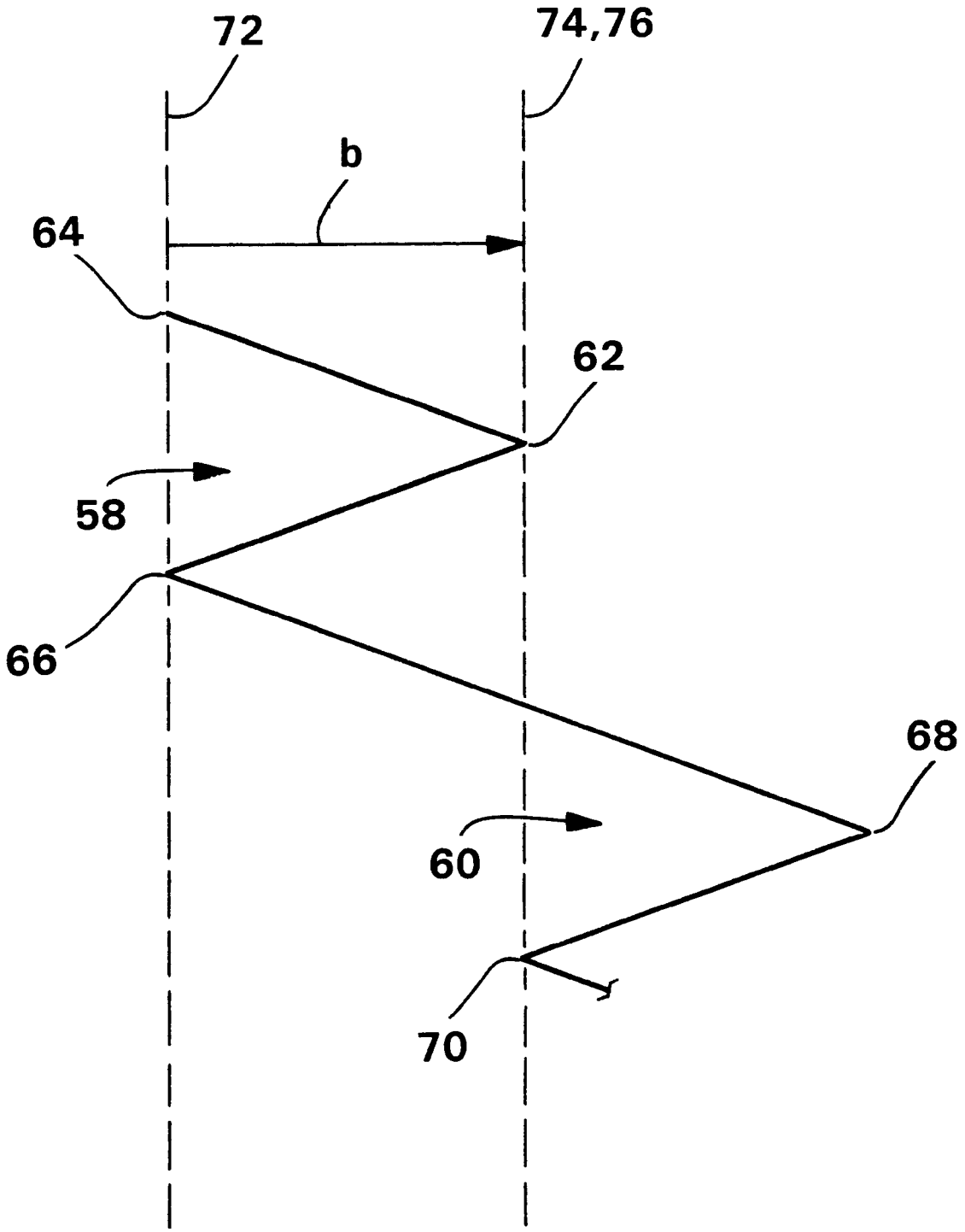
FIG. 5 is a cross-sectional view of two adjacent single type pleats, slightly opened for clarity, which have 0% juxtaposition and are not offset.

FIG. 5 is a cross-sectional view of two adjacent right-hand single pleats which have 0% juxtaposition. This is so because there is no distance between lines 74 and 76 and zero divided by any number remains zero.

Figure 6:
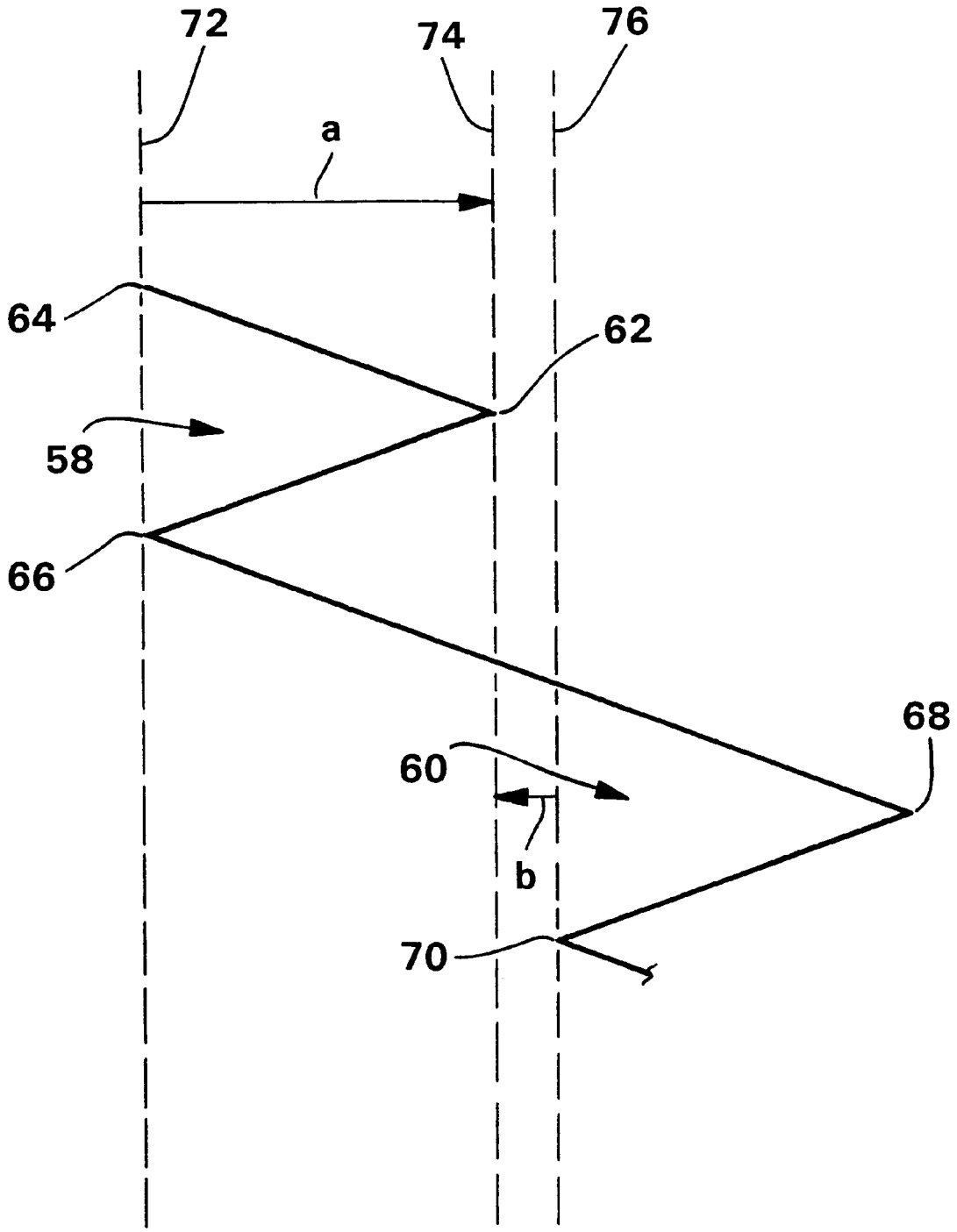
FIG. 6 is a cross-sectional view of two adjacent single type pleats, slightly opened for clarity, which have 0% juxtaposition and are offset.

FIG. 6 is a cross-sectional view of two adjacent right-hand single pleats which have negative juxtaposition or offset. That is, the terms negative juxtaposition and offset refer to the same configuration. Here there is a distance "b" between lines 76 and 74. However, line 76 is on the opposite side of line 74 from line 72. In other words, pleat 60 is offset laterally from pleat 58. If a percent juxtaposition is desired, it is calculated as above with the exception that it would be given a negative value.

Figure 7:
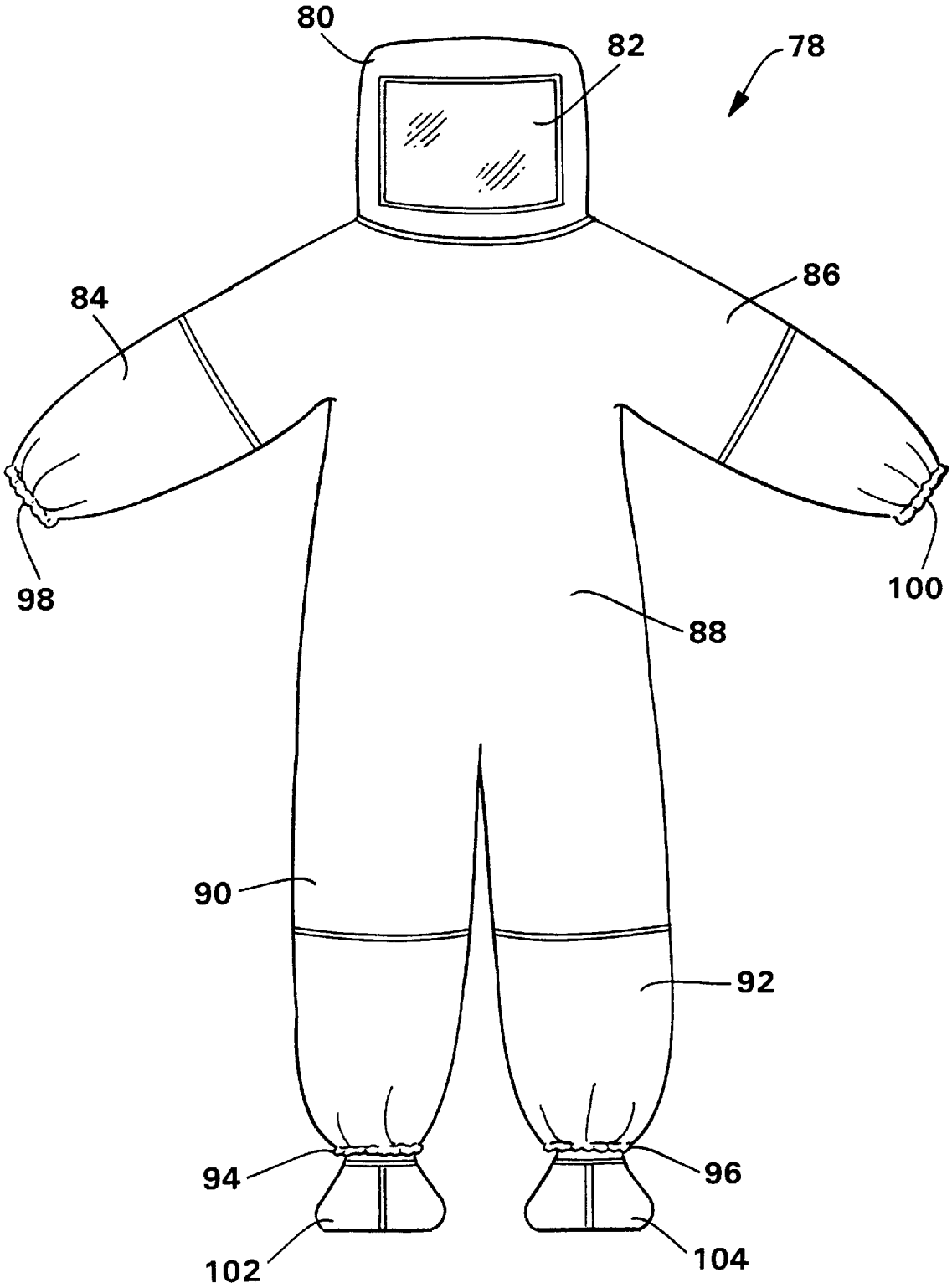
FIG. 7 is a frontal view of one embodiment of a protective garment of the present invention.

With the above background in mind we may turn our attention to FIG. 7 which illustrates a frontal view of a protective garment 78. The protective garment 78 includes a head receiving portion 80 with a view plate 82. The protective garment also includes left and right arm receiving portions 84, 86, a body receiving portion 88 and left and right leg receiving portions 90, 92. The protective garment 78 may include left and right ankle elastic portions or cuffs 94, 96 and left and right wrist elastic portions or cuffs 98, 100 which form a tight fit around the wearer's wrists and ankles in order to maintain the interior of the protective garment in a non-contaminated state. In some embodiments the protective garment 78 may also include left and right foot or shoe covering portions 102, 104.

Figure 8:
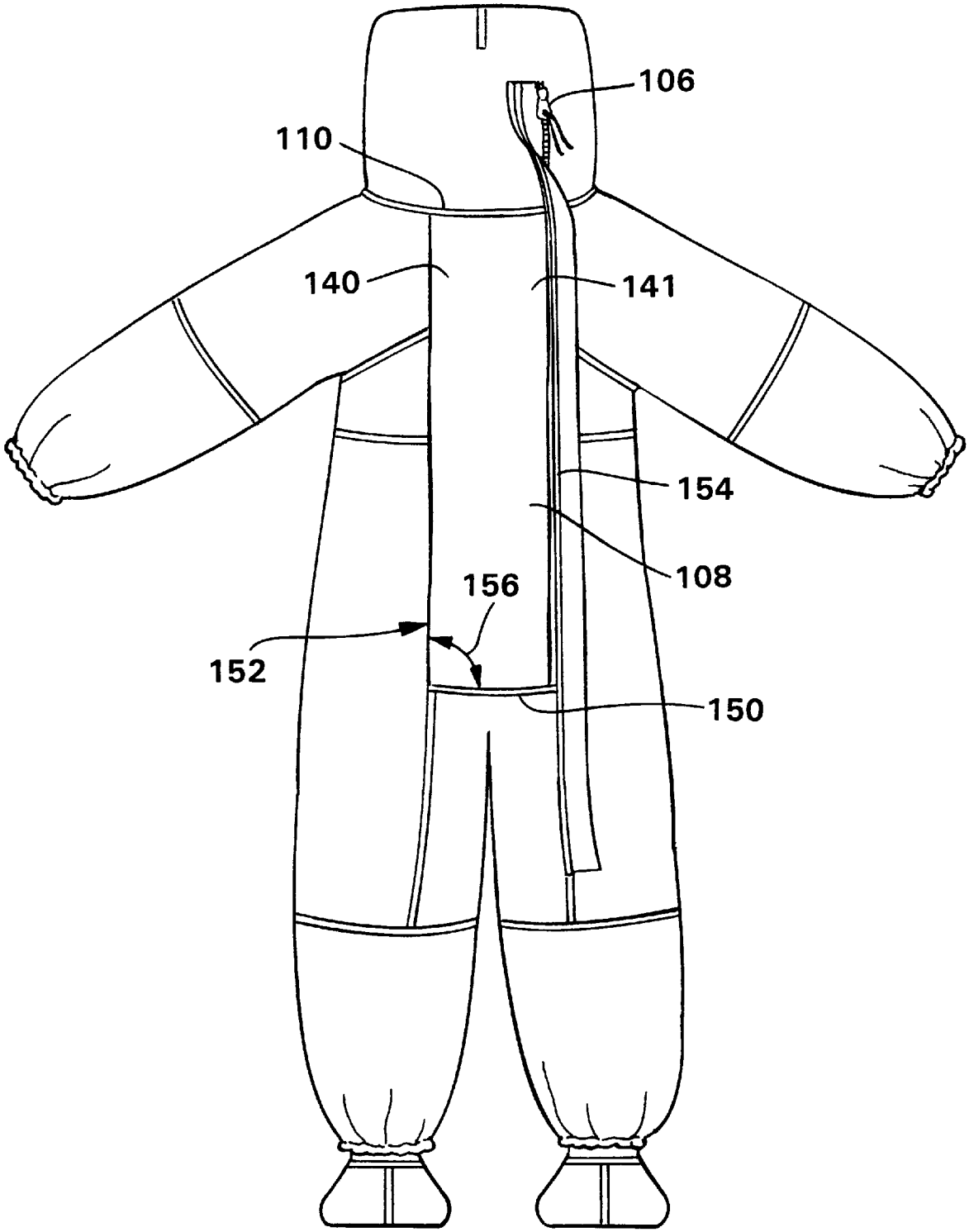
FIG. 8 is a rear or back view of the protective garment illustrated in FIG. 7.

FIG. 8 is a rear or back view of the protective garment 78. FIG. 8 illustrates that the protective garment 78 may be entered from the rear through the use of a zipper 106. FIG. 8 also illustrates that the protective garment 78 has been provided with a backpack 108 which has the ability to variably expand to encompass or receive a variety of types of equipment (not shown) carried on the back of the wearer. In this embodiment, the backpack begins or has a top or upward termination edge or line 110 where the helmet or head receiving portion 80 ends. Desirably, this upward edge or line 110 forms an upwardly facing concavity. This configuration allows ease of transition from the base of the generally circular helmet or head portion 80 and makes it easier for the wearer to turn his/her head back and forth. Naturally, other embodiments where the upward termination edge 110 of the backpack 108 is below the head portion and/or straight are contemplated.

Figure 9:
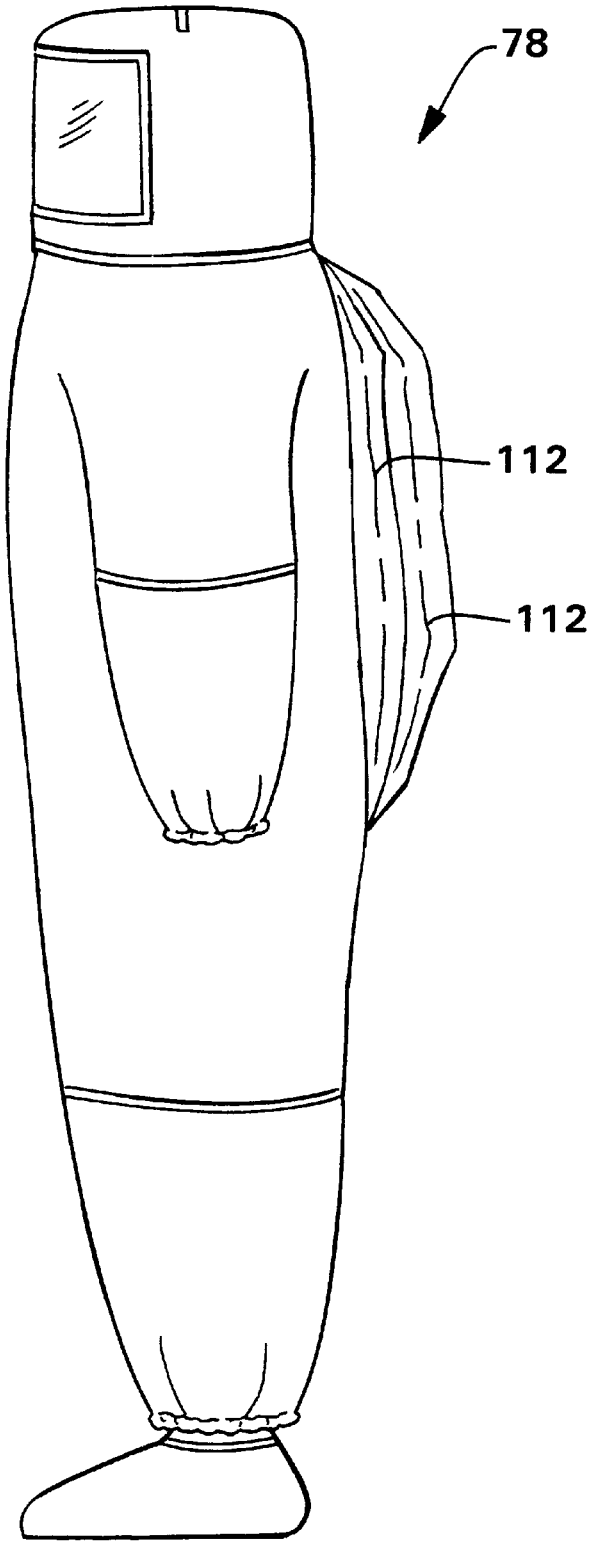
FIG. 9 is a side or lateral view of the protective garment illustrated in FIG. 7.

FIG. 9 is a side view of the protective garment 78. FIG. 9 illustrates that each side of the backpack 108 is provided with one or more generally vertically extending pleats 112 which may be urged partially or totally open through contact with equipment worn on the back of the wearer. The pleats 112 utilized may be single type 10, double type 18, triple type 34 or greater multiple type pleats 112, as desired. The pleats 112 may have either positive, negative (be offset) or no juxtaposition of any degree. One desirable embodiment of the present invention is provided with two pairs of double pleats 18 which have 0% juxtaposition. This configuration is illustrated, in cross-section, in FIG. 10.

Figure 10:
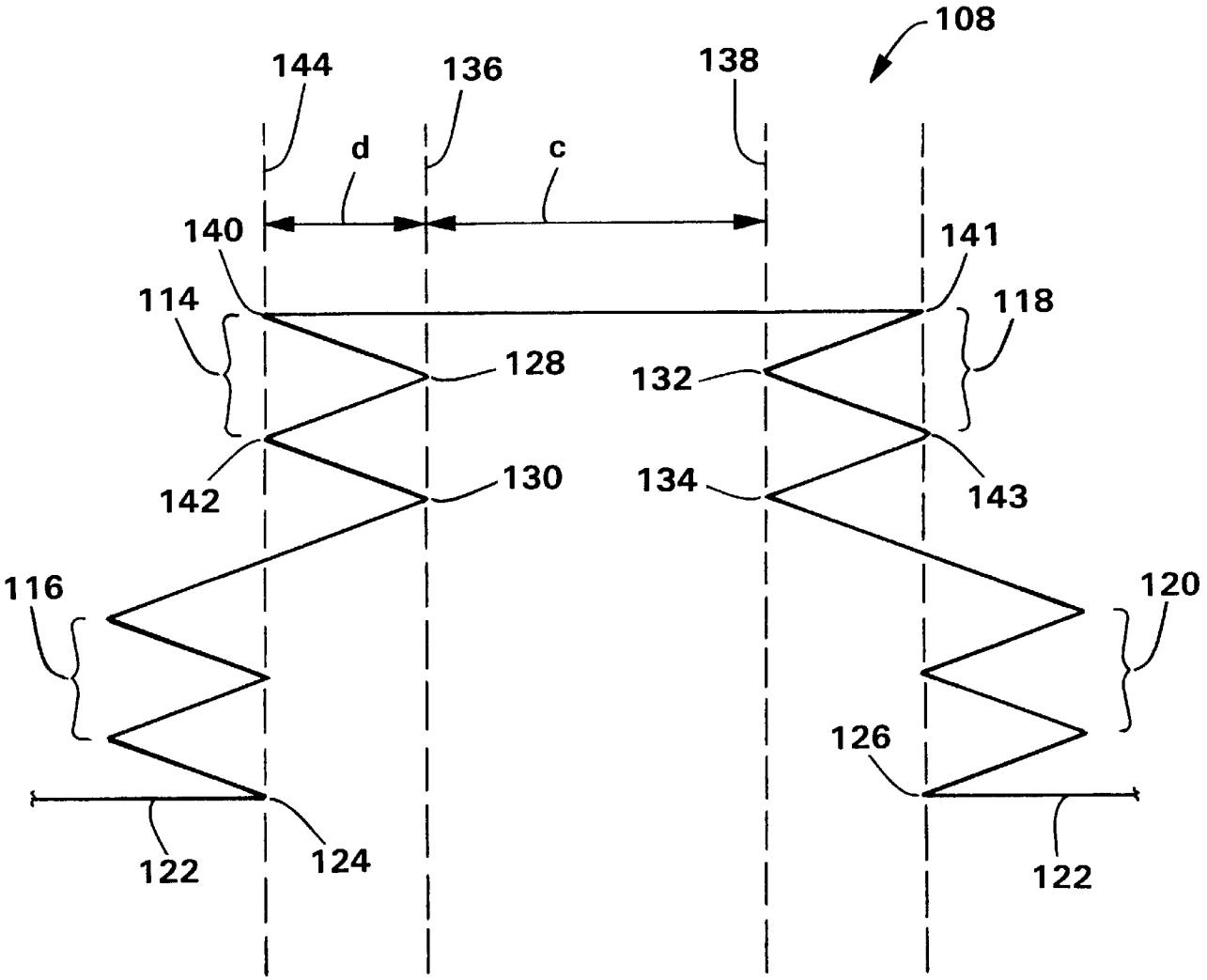
FIG. 10 is a cross-sectional view of one particular pleat configuration in accordance with the teachings of the present invention with the pleats partially opened for clarity.

FIG. 10 illustrates, in cross-section, a backpack 108 embodiment having two pairs of left and right double pleats. That is to say, the left double pleats 114 and 116 are paired with right double pleats 118 and 120 respectively. A flange of material 122 extends laterally outward from the lowermost inner fold lines or points 124, 126 so that the backpack may be readily joined to the body of the protective garment 78 by sewing, adhesives, thermal bonding or other suitable means.

FIG. 10 also illustrates another feature of some embodiments of the present invention. To best grasp this concept, it is necessary to construct imaginary lines. The first imaginary line is constructed by passing a line through the two inner fold points or lines 128, 130 of the top or uppermost left double pleat 114 to form line 136. The second imaginary line is constructed by passing a line through the two inner fold points 132, 134 of the top or uppermost right double pleat 118 to form line 138. It has been found desirable for the distance "c" between lines 136 and 138 to be at least 0.25 inch. For example, the distance "c" may be at least 0.5 inch. This configuration keeps the left 128, 130 and right 132, 134 inner fold points or lines from touching or otherwise inhibiting each others movement as the pleats 114, 118 open in response to contact with back worn equipment.

FIG. 10 also illustrates the concept of pleat width. To understand pleat width, it is necessary, for example, to construct an imaginary line which passes through the two outer pleat fold points or lines 140, 142 of the uppermost left-hand double pleat 114. This forms line 144 which is a distance "d" form line 136. "d" is the width of the pleat 114. When single or double pleats are used, the pleat width should vary between about 1.5 and 2.5 inches. For example the pleat width may be about 2 inches. When triple pleats are used, the pleat width should vary between about 2.5 to 3 inches. The length The vertical dimension when the wearer is standing of the backpack 108 may be varied depending upon the size of the suit manufactured and the equipment it is designed to enclose. Typical backpack 108 lengths would range from 25 to 35 inches. One desirable length is about 31.5 inches.

Figure 11:
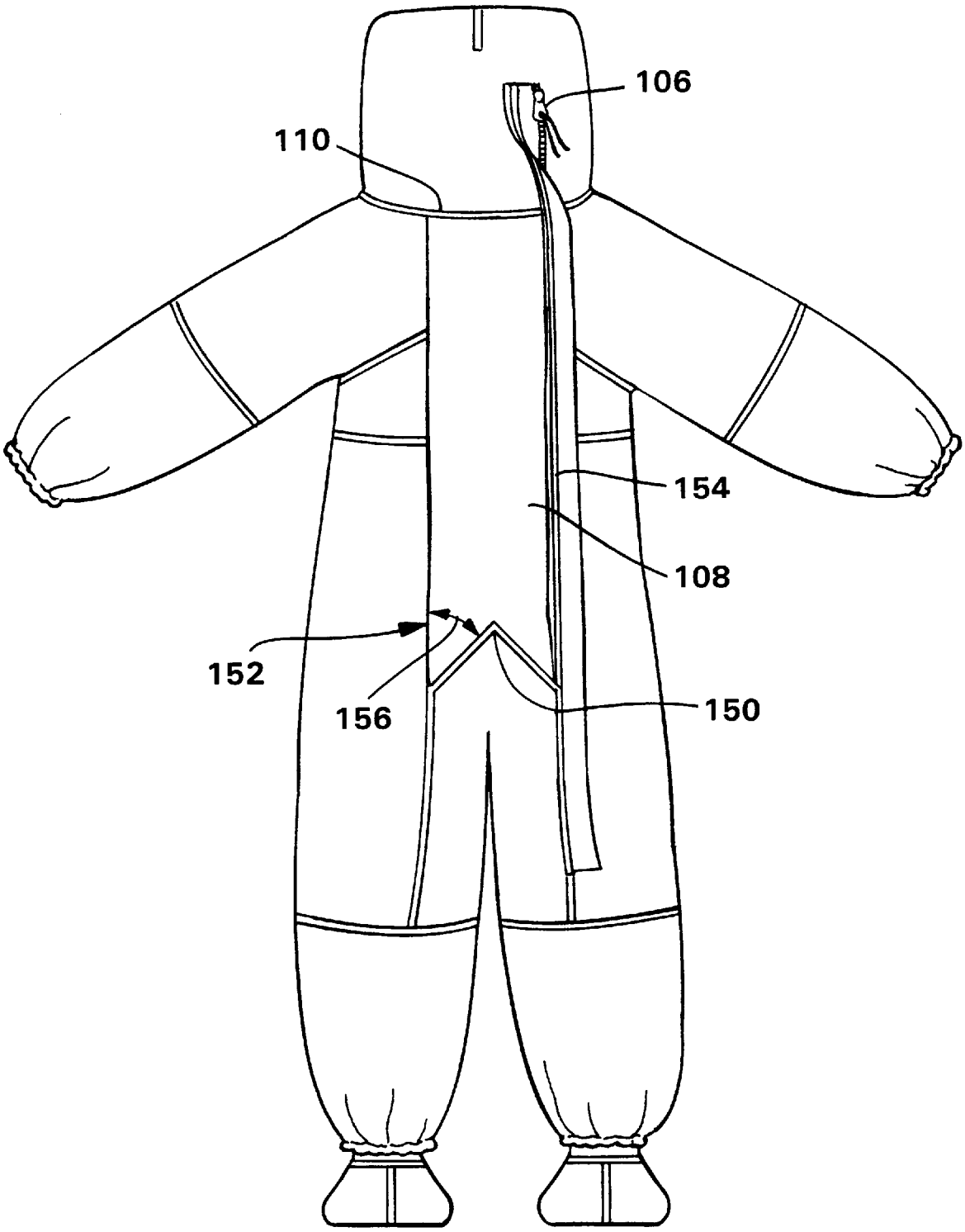
FIG. 11 is a rear or back view of another embodiment of the protective garment of the present invention.

FIG. 8 illustrates that, in some embodiments, the generally vertical (when the wearer is standing) pleats terminate at the bottom edge 150 with a seal or seam that is generally perpendicular (90 degrees) to the generally vertical inner and outer pleat fold lines. (The outer pleat fold lines form the outer edges 152, 154 of the backpack 108.) This configuration is not totally satisfactory in that, during use, contaminates tend to collect in the semi-pocket formed between the pleats just above the backpack/pleat termination seal/seam at 150. This configuration has a 90 degree contaminate runoff angle. The contaminate runoff angle is determined by measuring the angle formed by the outer fold lines of a pleat (which are the same as the lateral edges 152, 154 of the backpack 108 when the wearer is standing) with the line formed by the lower termination of the pleat. This angle is denoted in FIG. 8 at 156. In order to overcome this problem, it has been found to be desirable to angle the lower backpack/pleat termination seal/seam 150 downward as illustrated in FIG. 11. This permits contaminates which fall in the pocket area to run (if liquid) or fall (if solid) out of the bottom pleat pocket area and not collect therein. In other words, to effect runoff, this contaminate runoff angle should be less than 90 degrees. For example, the contaminate runoff angle may vary from between about 30 and 60 degrees. More particularly, the contaminate runoff angle may be about 45 degrees.

Figure 12:
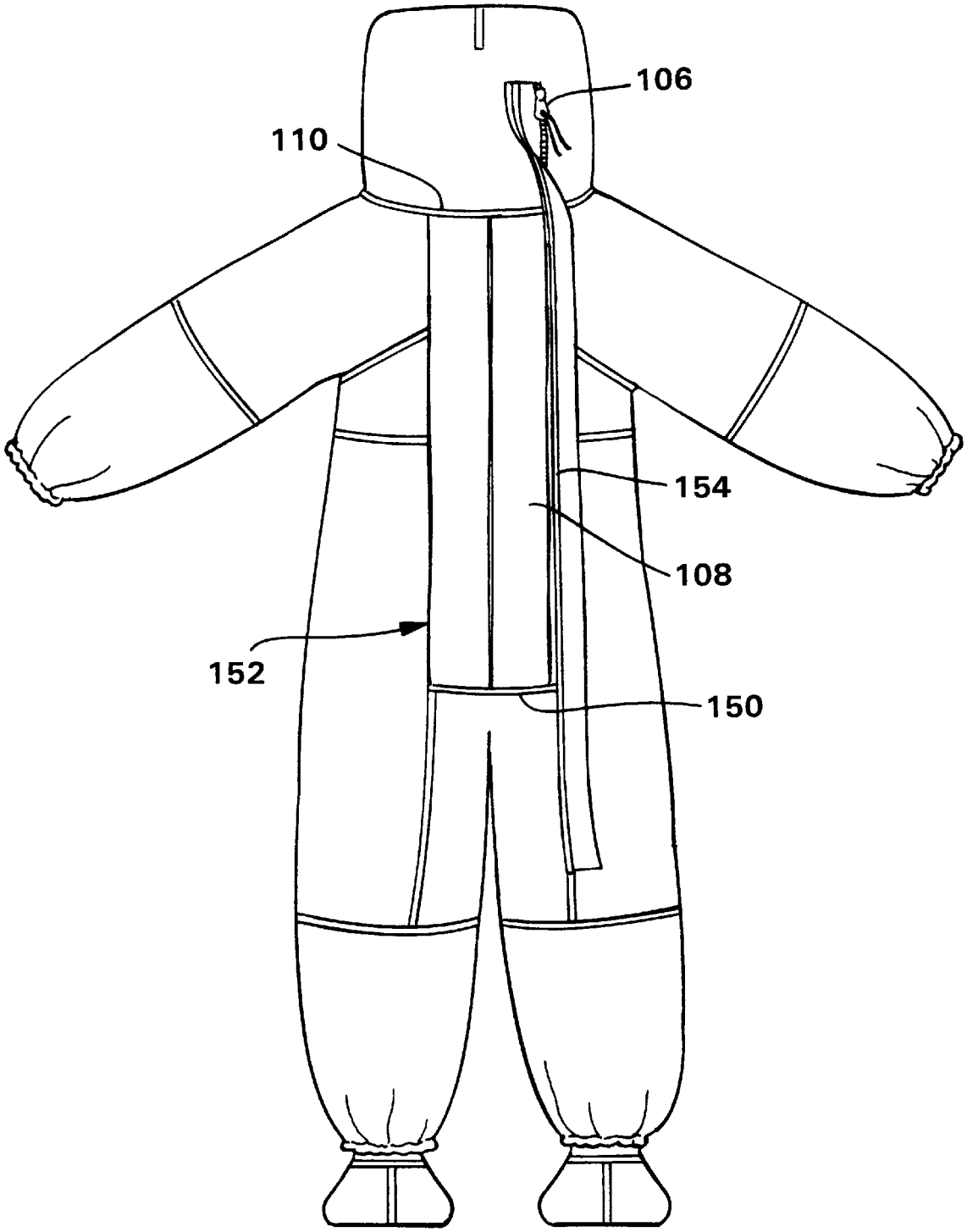
FIG. 12 is a rear or back view of yet another embodiment of the protective garment of the present invention.

Other backpack 108 configurations will be readily apparent to those of skill in the art. For example, FIGS. 8, 9 and 11 illustrate an embodiment where left and right pleats are used on each side of the backpack 108. If desired, the backpack could be further compartmentalized as is illustrated in FIG. 12. Here two separate generally vertical pleat compartments would make up the backpack 108. That is, one compartment with left and right pairs of pleats would be aligned generally parallel to another compartment with its own sets of left and right pleat pairs. Naturally, other embodiments could include three or more generally vertical compartments.

While the invention has been described in detail with respect to specific preferred embodiments thereof, it will be appreciated that those skilled in the art, upon attaining an understanding of the foregoing, may readily conceive of alterations to and variations of the preferred embodiments. Such alterations and variations are believed to fall within the scope and spirit of the invention and the appended claims.

What is claimed is:

1. A protective garment adapted to enclose a wearer of the protective garment and equipment worn on the wearer's back, the protective garment comprising:

a head receiving portion including a view plate;

left and right arm receiving portions;

a body receiving portion including an expandable backpack portion located on a back area of the body receiving portion with the backpack portion being adapted to receive and enclose equipment worn on the back of the wearer and comprising at least one pair of left and right generally vertical pleats terminating in a contaminant runoff angle of greater than 0 degrees and less than 90 degrees; and left and right leg receiving portions; and whereby the backpack portion is adapted to expand to receive and enclose equipment worn on the back of the wearer of the protective garment.

2. The protective garment according to claim 1, wherein the pleats are single pleats.

3. The protective garment according to claim 2, wherein the single pleats have a width of from about 1.5 inch to about 2.5 inches.

4. The protective garment according to claim 2, wherein the single pleats have a width of about 2 inches.

5. The protective garment according to claim 1, wherein the pleats are double pleats.

6. The protective garment according to claim 5, wherein the double pleats have a width from about 1.5 inch to about 2.5 inches.

7. The protective garment according to claim 5, wherein the double pleats have a width of about 2 inches.

8. The protective garment according to claim 1, wherein the pleats are triple pleats.

9. The protective garment according to claim 8, wherein the triple pleats have a width of from about 2.5 to 3 inches.

10. The protective garment according to claim 1, comprising at least two pairs of generally vertical pleats.

11. The protective garment according to claim 10, wherein the pairs of pleats are juxtaposed 0% and not offset.

12. The protective garment according to claim 10, wherein the pairs of pleats are offset.

13. The protective garment according to claim 1, wherein the contaminate runoff angle is from about 30 degrees to about 60 degrees.

14. The protective garment according to claim 1, wherein the contaminate runoff angle is about 45 degrees.

15. The protective garment according to claim 1 having an uppermost pair of left and right pleats with inner pleat folds separated by at least 0.5 inch.

16. The protective garment according to claim 1, having an uppermost pair of left and right pleats with inner pleat folds separated by at least 0.25 inch.

17. The protective garment according to claim 1, wherein the backpack portion is adapted to variably expand to receive equipment worn on the back of the wearer of the protective garment.

18. A protective garment adapted to enclose a wearer of the protective garment and equipment worn on the wearer's back, the protective garment comprising:

a head receiving portion including a view plate;

left and right arm receiving portions;

a body receiving portion including an expandable backpack portion located on a back area of the body receiving portion with the backpack portion being adapted to receive and enclose equipment worn on the back of the wearer and comprising at least one pair of left and right generally vertical pleats; and left and right leg receiving portions; and wherein the left and right generally vertical pleats terminate, at the top, to define an upward concave arc; and whereby the backpack portion is adapted to expand to receive equipment worn on the back of the wearer of the protective garment.

19. A protective garment adapted to enclose a wearer of the protective garment and equipment worn on the wearer's back, the protective garment comprising:

a head receiving portion including a view plate;

left and right arm receiving portions;

a body receiving portion including an expandable backpack portion located on a back area of the body receiving portion with the backpack portion being adapted to receive and enclose equipment worn on the back of the wearer and comprising at least one pair of left and right generally vertical pleats terminating, at the bottom, in a contaminant runoff angle of greater than 0 degrees and less than 90 degrees; and left and right leg receiving portions; and wherein the left and right generally vertical pleats terminate, at the top, to define an upward concave arc; and whereby the backpack portion is adapted to expand to receive equipment worn on the back of the wearer of the protective garment.

20. The protective garment according to claim 19, wherein the backpack portion is adapted to variably expand to receive equipment worn on the back of the wearer of the protective garment.

* * * * *